United States Patent [19]

Beardmore

[11] Patent Number: 4,590,964

[45] Date of Patent: May 27, 1986

[54] NOISE ISOLATION FOR A FUEL SYSTEM

[75] Inventor: John M. Beardmore, Howell, Mich.

[73] Assignee: General Motors Corporation, Detroit, Mich.

[21] Appl. No.: 727,596

[22] Filed: Apr. 26, 1985

[51] Int. Cl.[4] ..... E03B 11/16; F04B 11/00

[52] U.S. Cl. ..... 137/565; 137/590; 417/363

[58] Field of Search ..... 417/360, 363; 137/565, 137/590, 592

[56] References Cited

U.S. PATENT DOCUMENTS

| | | | |
|---|---|---|---|
| 3,250,461 | 5/1966 | Parker | 417/363 |
| 3,698,833 | 10/1972 | Cann et al. | 417/363 |
| 3,926,537 | 12/1975 | Piper | 417/363 |
| 4,304,530 | 12/1981 | Gens | 417/360 |
| 4,306,844 | 12/1981 | Otto et al. | 417/363 |

*Primary Examiner*—A. Michael Chambers

*Attorney, Agent, or Firm*—Donald F. Scherer

[57] ABSTRACT

An electric motor driven fuel pump is mounted in a fuel tank with noise isolators to decouple the fuel pump and the fuel lines from the fuel tank and the vehicle body structure. The fuel discharge line is isolated from the pump discharge passage by an elastomeric connector, and both the fuel discharge and fuel return lines are isolated from the fuel tank by resilient elastomeric grommets. A reaction mass is connected to the discharge line and the return line and isolated from the fuel tank. The reaction mass provides a significant change in the mechanical impedance of the system and thereby absorbs a majority of the fuel pump vibratory energy.

2 Claims, 1 Drawing Figure

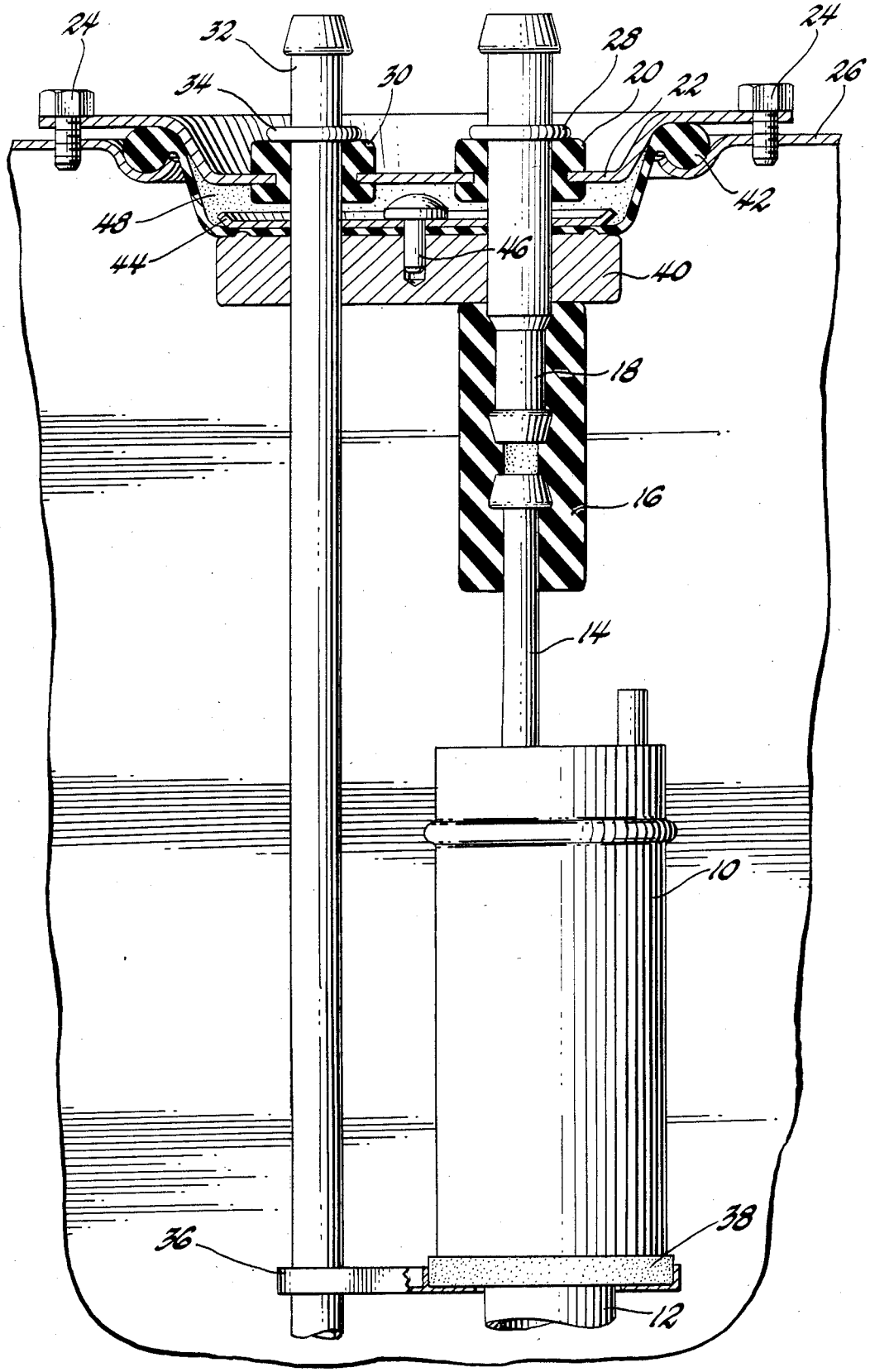
24
32
28
24
34
30
20
22
26
42
48
46
44
40
18
16
14
10
38
36
12

NOISE ISOLATION FOR A FUEL SYSTEM

BACKGROUND OF THE INVENTION

This invention relates to intank fuel pump systems and more particularly to noise reduction means for intank fuel pump systems.

Some prior art fuel systems have suggested that the intank fuel pump be encased in a foam material to reduce noise radiation therefrom. Other prior art systems have suggested an elastomeric passage coupling for the pump discharge. These systems have not been entirely effective in isolating the fuel pump or the fuel line from the fuel tank and therefore vibratory energy is transmitted to the system structure on which the fuel tank is mounted.

SUMMARY OF THE INVENTION

It is an object of this invention to provide a noise isolation system for a fuel system having an intank fuel pump wherein the discharge of the fuel pump is isolated by an elastomeric coupler from the fuel discharge passage, and wherein both the fuel discharge passage and the fuel return passage are isolated by elastomeric grommets from the fuel tank, and also wherein a reaction mass is secured to both fuel passages to provide a mechanical impedance to absorb vibratory energy from the fuel pump.

It is another object of this invention to provide an improved noise isolation structure for an electric motor driven intank fuel pump having a fuel discharge pipe and fuel return pipe which are mounted in a fuel tank cover and acoustically isolated therefrom by elastomeric grommets having secured thereto a reaction mass for absorbing vibratory energy from the fuel pump, and also wherein the discharge passage of the pump is connected with the fuel discharge pipe through an elastomeric coupling.

These and other objects and advantages of the present invention will be more apparent from the following specification and drawings.

DESCRIPTION OF THE DRAWINGS

An elevational view of a portion of a fuel system disposed within a fuel tank is shown.

DESCRIPTION OF THE PREFERRED EMBODIMENT

The fuel system shown in the drawing includes a conventional electric motor driven fuel pump 10 which has a fuel inlet 12 and a pump discharge passage or pipe 14. The pump discharge passage 14 is secured to an elastomeric coupling 16, which in turn has secured thereto, a fuel discharge passage or pipe 18. The fuel discharge pipe 18 has sealingly engaged therewith an elastomeric grommet 20 which is secured in a fuel tank cover plate 22. The fuel tank cover plate 22 is secured by a plurality of fasteners 24 to a fuel tank 26. The fuel tank 26 is secured to a vehicle frame, not shown, in a conventional manner. The fuel discharge pipe 18 has a flared portion 28 which prevents movement of the fuel pipe 18 downward, as seen in the drawing, relative to the gromment 20. Also disposed in the cover 22 is a grommet 30 which sealingly engages a fuel return pipe or passage 32. A flared portion 34 is integrally formed on the fuel return pipe 32 to limit the downward movement of the pipe 32 relative to the grommet 30.

The lower end of fuel return pipe 32 has secured thereto a strap 36 which includes an elastomeric isolator portion 38 which engages the fuel pump 10 to provide some support therefor. The fuel pump 10 is supported within the fuel tank 26 by the fuel discharge pipe and fuel return pipe through the isolators 16 and 38.

A reaction mass 40 is secured to both the fuel discharge pipe 18 and the fuel return pipe 32. The reaction mass 40 is supported on the cover 22 through flared portions 28 and 34 or the pipes 18 and 32 and their respective grommets 20 and 30. The reaction mass 40 is therefore acoustically isolated from the fuel tank cover 22. A seal member 42 is disposed between the cover 22 and the fuel tank 26 to prevent fuel leakage. The seal 42 is maintained in sealing engagement with the reaction mass 40 by a plate 44 and a rivet 46. This seal arrangement prevents fuel from entering the space 48 which is formed between the cover plate 22 and the reaction mass 40. Since the weight of the reaction mass is supported by the pipes 18 and 32, the seal 42 does not have any significant vertical load imposed thereon. If desired, a vent tube or other passage means can be included. These additional members would be secured to the reaction mass 40 and isolated from the cover 22 in a manner similar to that described above for the discharge and return pipes 18 and 32.

The isolators 16 and 38 provide the first stage of noise isolation between the fuel pump 10 and the fuel tank cover 22 and therefore fuel tank 26. However, these isolators are not sufficient to eliminate all of the vibratory energy which is transmitted by the fuel pump 10 and the fuel discharge therefrom. The grommets 20 and 30 provide noise isolation between the pipes 18 and 32, and the cover 22. This eliminates the direct transmission of vibratory energy between the pipes 18 and 32 and the fuel tank 26. The reaction mass 40, in cooperation with the grommets 20 and 30, provide the second stage of noise isolation. The reaction mass 40 establishes a large mechanical impedance on the pipes 18 and 32 such that vibration of these pipes cannot be maintained by the vibratory energy originated at the fuel pump. This prevents the fuel pipes 18 and 32 from being excited and substantially eliminates any mechanical vibrations which might otherwise be transmitted to the fuel tank 26.

The isolator 38 prevents mechanical noise transmission from the fuel pump 10 to the fuel return pipe 32 while permitting the fuel return pipe 32 to provide some vertical support for the fuel pump 10. A fuel system incorporating the above described noise isolation was tested against a similar fuel system without the second stage of noise isolation.

The improved system described above provided a noise reduction in the range of 5 to 10 db(A) within the operating range of the pump. In the system tested, the reaction mass was 300 grams and the grommets 20 and 30 were formed of silicon rubber having a 40 durometer hardness. It was found that decreasing the reaction mass and/or decreasing the grommet stiffness will result in degradation of the noise isolation performance.

As explained above, the seal 42 is not a part of the noise isolation system but serves only to retain fuel within the tank. The reaction mass 40 is not suspended from the seal but is positioned by the grommets 20 and 30 as previously explained. Therefore, the stiffness or hardness of the seal material is not a significant factor in the noise isolation system. Therefore, the material for the seal 42 can be reinforced rubber fabric similar to the material used in conventional mechanical fuel pump diaphragms.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. An improvement in noise isolators for fuel systems having a fuel tank, an electric motor driven fuel pump disposed within the tank, fuel discharge passage means and return passage means for directing fuel from and to the fuel tank respectively wherein the improvement comprises; a cover plate for closing an opening in said fuel tank; elastomeric grommet means sealingly engaging cover plate and sealingly engaging said discharge passage means and said return passage means for isolating said passage means from said cover plate and said fuel tank; flared portion means on each of said passage means abutting the said gromment means for limiting movement of said passage means relative to said grommet toward the interior of the fuel tank; and reaction mass means secured to both of said passage means for providing a mechanical impedance for absorbing vibratory energy from the fuel pump.

2. An improvement in noise isolators for fuel systems having a fuel tank, an electric motor driven fuel pump having a pump discharge passage is disposed within the tank, a fuel discharge pipe and return pipe for directing fuel from and to the fuel tank respectively, wherein the improvement comprises; a cover plate for closing an opening in said fuel tank; elastomeric grommet means sealingly engaging said cover plate and sealingly contacting said discharge pipe and said return pipe for isolating both said pipes from said cover plate and said fuel tank; flared portion means on each of said pipes abutting the said grommet means for limiting movement of both said pipe relative to said grommet toward the interior of the fuel tank; reaction mass means secured to both said pipe for providing a mechanical impedance for absorbing vibratory energy from the fuel pump; seal means sealing contacting said cover plate, said fuel tank and said reaction mass means for preventing fuel leakage from said tank; and an elastomeric coupler means connecting said pump discharge passage and said fuel discharge pipe for permitting the flow of fuel therebetween and reducing the transmission of vibratory energy from said pump discharge passage to said fuel discharge pipe.

* * * * *

UNITED STATES PATENT AND TRADEMARK OFFICE

CERTIFICATE OF CORRECTION

PATENT NO. : 4,590,964

DATED : May 27, 1986

INVENTOR(S) : John M. Beardmore

It is certified that error appears in the above-identified patent and that said Letters Patent is hereby corrected as shown below:

Column 2, line 59, "decreasing" should read -- increasing --.

Signed and Sealed this

Thirteenth Day of January, 1987

*Attest:*

DONALD J. QUIGG

*Attesting Officer*

*Commissioner of Patents and Trademarks*